US010497349B1

(12) United States Patent
Boxberger

(10) Patent No.: US 10,497,349 B1
(45) Date of Patent: Dec. 3, 2019

(54) SOLENOID TRIGGERED MUSICAL STRINGED INSTRUMENT

(71) Applicant: Frank Dale Boxberger, Scottsdale, AZ (US)

(72) Inventor: Frank Dale Boxberger, Scottsdale, AZ (US)

( * ) Notice: Subject to any disclaimer, the term of this patent is extended or adjusted under 35 U.S.C. 154(b) by 0 days.

(21) Appl. No.: 16/193,829

(22) Filed: Nov. 16, 2018

Related U.S. Application Data

(60) Provisional application No. 62/587,021, filed on Nov. 16, 2017.

(51) Int. Cl.

| | |
|---|---|
| ***G10H 3/00*** | (2006.01) |
| ***G10H 3/22*** | (2006.01) |
| ***G10D 3/04*** | (2006.01) |
| ***G10D 3/06*** | (2006.01) |
| ***G10D 3/10*** | (2006.01) |

(52) U.S. Cl.
CPC ..... *G10H 3/22* (2013.01); *G10D 3/04* (2013.01); *G10D 3/06* (2013.01); *G10D 3/10* (2013.01); *G10H 2220/461* (2013.01)

(58) Field of Classification Search
CPC .. G10H 1/00; G10H 1/18; G10H 1/20; G10H 1/44; G10D 1/085; G10D 1/00; G10D 3/143; G10G 1/00; G10G 7/02
See application file for complete search history.

(56) References Cited

U.S. PATENT DOCUMENTS

| | | | | |
|---|---|---|---|---|
| 5,380,948 | A | 1/1995 | Freimuth | |
| 5,390,579 | A * | 2/1995 | Burgon | G10D 3/14 84/297 R |
| 6,723,904 | B1 * | 4/2004 | Dolan | G10D 3/00 84/267 |
| 9,865,238 | B2 | 1/2018 | Demin | |
| 2005/0172779 | A1 * | 8/2005 | Gilmore | G10F 1/20 84/8 |

* cited by examiner

*Primary Examiner* — Marlon T Fletcher
(74) *Attorney, Agent, or Firm* — Plager Schack LLP; Mark H. Plager; Eric Liou

(57) ABSTRACT

A solenoid triggered electrical musical stringed-instrument is provided. The instrument includes a body with a bridge, a neck coupled to the body and having a plurality of frets, a plurality of strings extending over the plurality of frets and coupled to the neck and bridge, a plurality of solenoids coupled to the bridge of the body, each solenoid corresponding to one of the plurality of strings and designed to deploy and retract, and an open switch array coupled to the neck of the instrument and having a plurality of momentary switches electrically coupled to the plurality of solenoids, each momentary switch corresponding to one of the plurality of solenoids associated with one of the plurality of strings of the instrument. Any string or momentary switch is depressed to deploy the plunger of one of the solenoids to hammer one of the plurality of strings.

8 Claims, 4 Drawing Sheets

SOLENOID TRIGGERED MUSICAL STRINGED INSTRUMENT

RELATED APPLICATION

The application claims priority to provisional patent application U.S. Ser. No. 62/587,021 filed on Nov. 16, 2017, the entire contents of which is herein incorporated by reference.

BACKGROUND

The embodiments herein relate generally to musical stringed instruments. More specifically, embodiments of the invention relate to a guitar that permits a user to play the instrument using one or both hands.

Musical string instruments such as electrical guitars and bass guitars comprise a variety of components including a main body, neck, strings coupled to the neck and bridge of the main body, frets coupled to the neck, and one or more pickups coupled to the main body. Musicians generally have to use both hands when performing on the guitar. Specifically, a first hand depresses one or more strings on the neck while the second hand plucks or strums the one or more strings extending over the main body. This can be difficult for individuals who can only perform with one hand such as disabled individuals.

Several methods and devices exist for improving the ease of playing a musical stringed instrument as disclosed in U.S. Pat. Nos. 9,865,238, 6,723,904 and 5,380,948. These devices comprise a variety of components such as rotary plectrums and/or actuators designed to contact the strings of the musical stringed instrument to generate sounds. However, these methods and devices are limited for one or more of the following reasons: (1) the devices comprise complex components that increase the likelihood for component failure and/or increased repair costs; (2) the devices and methods do not provide the user the option of playing the musical stringed instrument with both hands to better simulate conventional musical instrument operation; and (3) the devices do not allow for open string actuation of one or more strings of the musical stringed instrument.

As such, there is a need in the industry for a solenoid triggered musical instrument such as a guitar that addresses the limitations of the prior art, which permits a user to perform on the musical instrument and generate sounds by using one or both hands. There is a further need for the solenoid triggered musical instrument to comprise simple components that eliminate unnecessary movements or combinations of movements when the components contact the strings to enhance component reliability and durability. There is a further need for the solenoid triggered musical instrument to enable the user to play open string notes on the instrument.

SUMMARY

A solenoid triggered actuating system for use with an electrical musical stringed-instrument to permit a user to play the instrument in single-hand and dual-hand operational modes is provided. The electrical musical stringed-instrument comprises a body with a bridge, a neck coupled to the body and comprising a plurality of frets disposed thereon, and a plurality of strings extending over the plurality of frets and comprising first ends coupled to the neck and second ends coupled to the bridge of the body. The system comprises a plurality of solenoids coupled to the bridge of the body, each solenoid in the plurality of solenoids corresponding to one of the plurality of strings of the instrument, each solenoid comprising a plunger configured to deploy and retract, and an open switch array coupled to the neck of the instrument and comprising a plurality of momentary switches electrically coupled to the plurality of solenoids, each momentary switch in the plurality of momentary switches corresponding to one of the plurality of solenoids associated with one of the plurality of strings of the instrument, wherein each string in the plurality of strings of the instrument is configured to be depressed to contact a corresponding one of the plurality of frets in the instrument to electrically couple the depressed string to the corresponding one of the plurality of solenoids, thereby deploying the plunger of the one of the plurality of solenoids to hammer the corresponding one of the plurality of strings to generate a first sound pertaining to a fretted note, wherein each momentary switch in the plurality of momentary switches is configured to be depressed to deploy the plunger of one of the plurality of solenoids to hammer the associated one of the plurality of strings to generate a second sound pertaining to an open string note.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
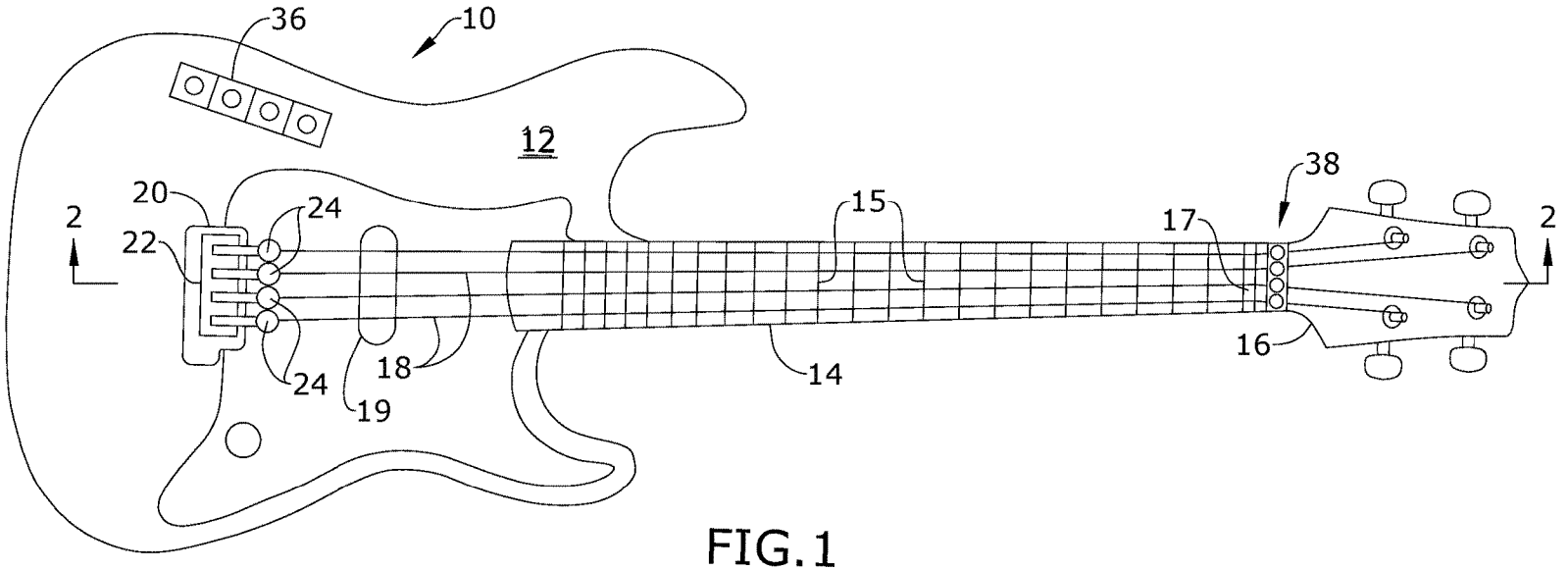
FIG. 1 depicts a front elevation view of certain embodiments of the musical stringed instrument.
Figure 2:
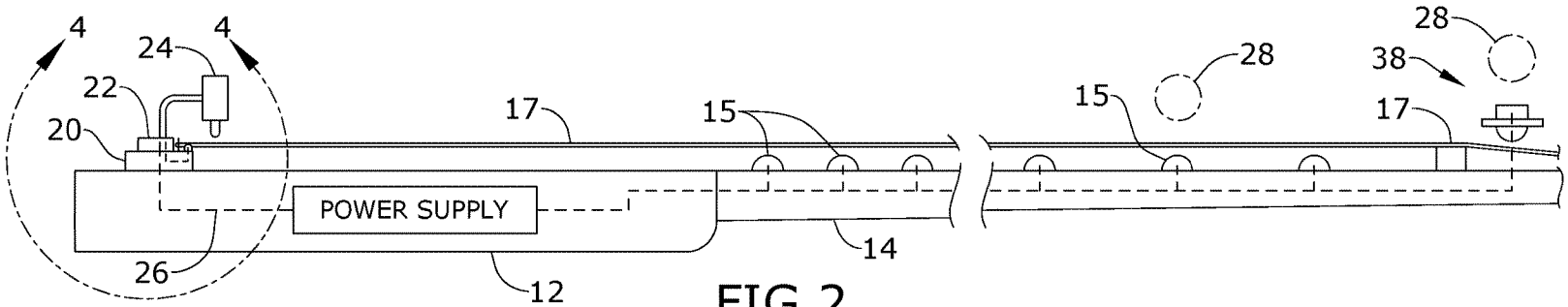
FIG. 2 depicts a side elevation view of certain embodiments of the musical stringed instrument taken along line 2-2 in FIG. 1.

As depicted in FIGS. 1-3, the musical instrument is preferably a guitar in one embodiment. However, the musical instrument can be any alternative electrical musical stringed instrument known in the field. In certain embodiments, guitar 10 generally comprises body 12, neck 14, frets 15, headstock 16, nut 17, strings 18, pickup 19, bridge 20 and solenoids 24. Body 12, neck 14 and headstock 16 are connected together and may have variable shapes, sizes and colors. In one embodiment, body 12, neck 14 and headstock 16 are made from various types of wood or other materials. Pickup 19, bridge 20 and solenoids 24 are coupled to body 12 using any number of fastening components known in the field. Frets 15 are coupled to neck 14.

Strings 18 comprise first ends coupled to bridge 20 and second ends coupled to headstock 16. Strings 18 extend over frets 15 and pickup 19 of guitar 10. A plurality of solenoids 24, one corresponding to each string 18, is coupled to bridge 20 above strings 18. In an alternative embodiment, solenoids 24 are coupled to guitar 10 and located below strings 18.

Figure 5:
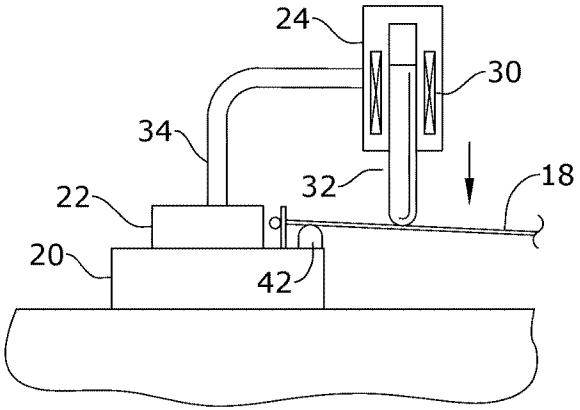
FIG. 5 depicts an elevation view of certain embodiments of the musical stringed instrument.
Figure 4:
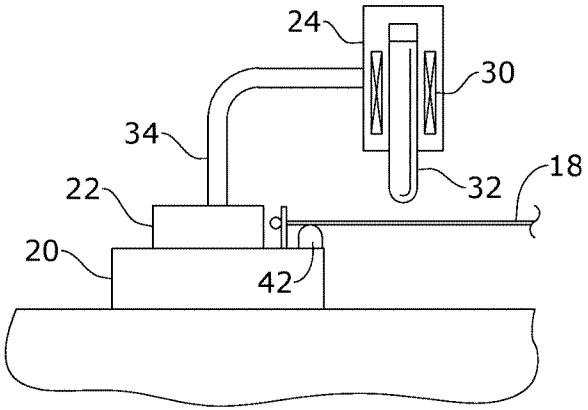
FIG. 4 depicts an elevation view of certain embodiments of the musical stringed instrument taken along line 4-4 in FIG. 2.
Figure 6A:
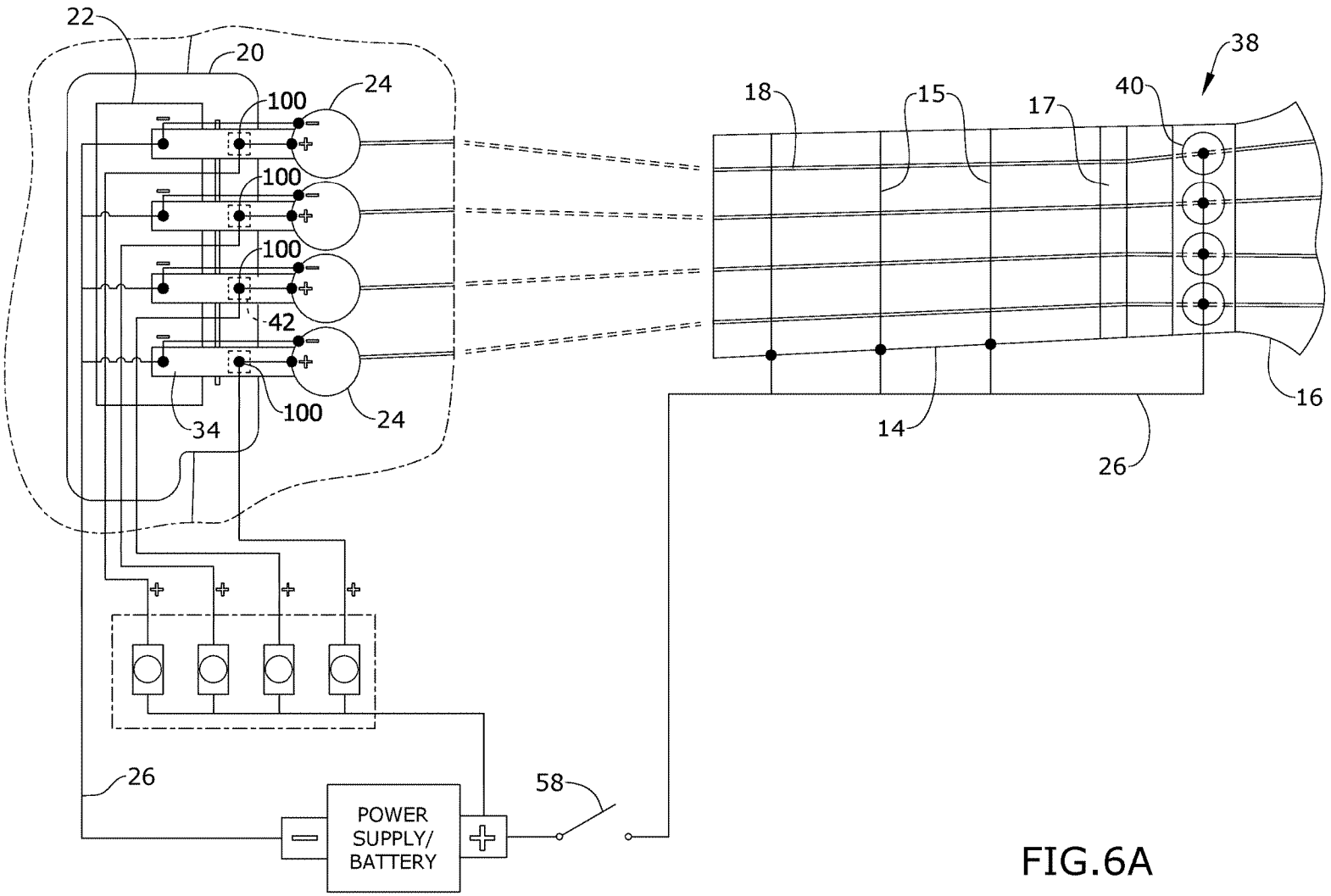
FIG. 6A depicts a schematic view of certain embodiments of the musical stringed instrument illustrating a circuit.

Solenoids 24 are preferably push/pull spring-loaded members connected to base 22, which is coupled to bridge 20. As depicted in FIG. 4, each solenoid 24 comprises arm 34, coil 30 and plunger 32. As depicted in FIG. 5, each solenoid 24 is configured to enable plunger 32 to hammer the corresponding string 18 when activated to generate a sound. As depicted in FIGS. 2 and 6A, solenoids 24 are electrically coupled to a power supply by wiring 26. Electric current flows through wiring 26 to coil 30 of an activated solenoid 24. The electric current in coil 30 creates a magnetic field that causes plunger 32 to linearly actuate in deployment to contact one of strings 18. The elimination of electric current in coil 30 disperses the magnetic field and causes the spring of solenoid 24 to automatically retract plunger 32 to the resting position away from string 18.

In certain embodiments, open string switch array 38 is coupled to neck 14 as depicted in FIGS. 1-3 and 6A. Open string switch array 38 comprises momentary switches 40, which correspond to strings 18. As depicted in FIG. 6A, each momentary switch 40 is electrically coupled to the power supply and one of solenoids 24 by wiring 26. In one embodiment, secondary momentary switches 36 are coupled to body 12 of guitar 10 as depicted in FIG. 1, and correspond to strings 18. Each secondary momentary switch 36 is electrically coupled to the power supply and one of solenoids 24 by wiring 26.

As depicted in FIG. 6A, solenoids 24 are electrically coupled to a power supply by wiring 26. Strings 18 are electrically coupled to both open switch array 38 and solenoids 24. Frets 15 and open string switch array 38 are both electrically coupled to the power supply by wiring 26. Frets 15 are electrically coupled to any one of strings 18 upon contact with the string. As such, frets 15 and strings 18 both act as electrical conduits.

In one embodiment, switch 58 is electrically coupled to frets 15 and open switch array 38. Switch 58 is configured to adjust to an ON position or an OFF position to open or close the circuit in wiring 26. In one embodiment, circuitry 100 is electrically coupled to each solenoid 24 and comprises at least a capacitor electrically coupled to a resistor. Each circuitry 100 is configured to convert a constant voltage to a one-time pulse, which facilitates the operation of each solenoid 24 as will be described in certain embodiments of the invention.

Figure 7:
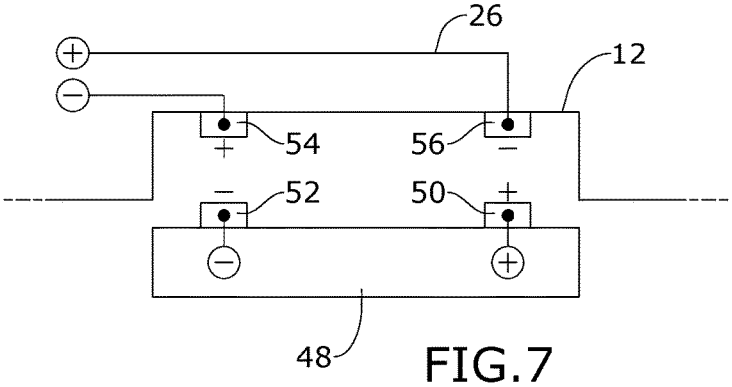
FIG. 7 depicts a schematic view of certain embodiments of the musical stringed instrument illustrating a battery.

The power source that supplies electricity to all of the components of guitar 10 and solenoids 24 may be an external power outlet or a battery. In one embodiment, electricity is supplied to wiring 26 of guitar 10 by battery 48 as depicted in FIG. 7. In this embodiment, battery 48 comprises (+) pole magnet battery post 50 and (−) pole magnet battery post 52, which are configured to detachably couple to corresponding (−) pole magnet quick-connect post 56 and (+) pole magnet quick-connect post 54, which are coupled to body 12 of guitar 10. In the coupled position, (+) pole magnet battery post 50 engages with (−) pole magnet quick-connect post 56 and (−) pole magnet battery post 52 engages with (+) pole magnet quick-connect post 54.

In operation, the user activates any number of solenoids 24 to permit one or more plungers 32 of the solenoids to directly contact one or more strings 18 of guitar 10 to generate one or more sounds pertaining to fretted notes or open string notes. Each solenoid 24 can be activated by one of the following actions: (1) depressing one of strings 18 against fret 15; (2) depressing one of momentary switches 40 in open string switch array 38; or (3) depressing one of secondary momentary switches 36.

Figure 3B:
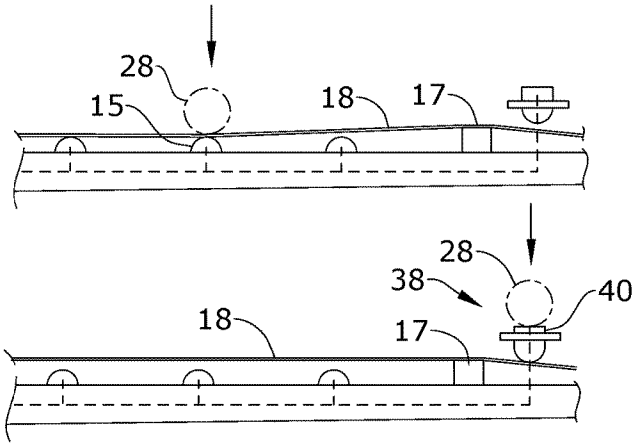
FIG. 3B depicts a side elevation view of certain embodiments of the musical stringed instrument illustrating the circuit closed on an open string.
Figure 3A:
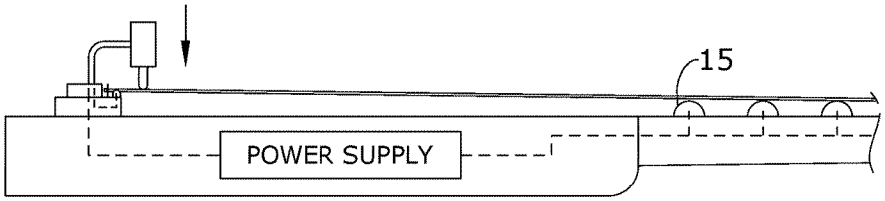
FIG. 3A depicts a side elevation view of certain embodiments of the musical stringed instrument illustrating the circuit closed at a fret.

More specifically, the user uses finger 28 to depress any number of strings 18 against any fret 15 as shown in FIG. 3A. The contact between the one or more depressed strings 18 and fret 15 closes the circuit and automatically deploys the corresponding one or more solenoids 24 corresponding to the one or more depressed strings 18 so that the one or more plungers 32 directly hammer the corresponding one or more strings 18. This generates one or more sounds pertaining to one or more fretted notes. The user can use any finger 28 to depress any other strings 18 against corresponding frets 15 in the same manner to activate one or more solenoids 24 as desired.

As depicted in FIG. 3B, the user depresses one or more momentary switches 40 on open string switch array 38 to permit the corresponding one or more solenoids 24 to directly hammer the associated one or more strings 18. This generates one or more sounds pertaining to one or more open string notes. Alternatively, the user depresses one or more secondary momentary switches 36 on body 12 to permit the corresponding one or more solenoids 24 to directly hammer the associated one or more strings 18. This generates one or more sounds pertaining to one or more open string notes.

If switch 58 is adjusted OFF to open the circuit, open string switch array 38 and the connection between strings 18 and frets 15 are disabled. This allows the user to use two hands to play guitar 10 by depressing any string 18 against neck 14 with a first hand and depressing secondary momentary switch 36 corresponding to the depressed string to activate solenoid 24 to generate a fretted note sound.

It shall be appreciated that the user may use any combination of one or both hands to depress strings 18, momentary switches 40 and secondary momentary switches 36 to enable guitar 10 to generate sounds pertaining to open string notes and fretted notes. The activation of any solenoid 24 by depressing any string 18, momentary switch 40 or secondary momentary switch 36 allows plunger 32 to automatically deploy to directly hammer the corresponding string 18 and retract to the resting position away from string 18. This automatic deployment and retraction of plunger 32 as a single cycle is facilitated by circuitry 100, which converts a constant voltage to a one-time pulse. The user has to repeat the depression of string 18, momentary switch 40 or secondary momentary switch 36 to repeat the cycle and reactivate the corresponding one or more solenoids 24.

Figure 6B:
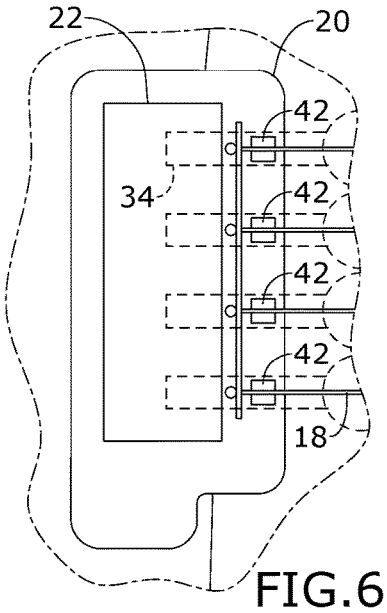
FIG. 6B depicts a schematic view of certain embodiments of the musical stringed instrument illustrating multiple bridge risers.
Figure 6C:
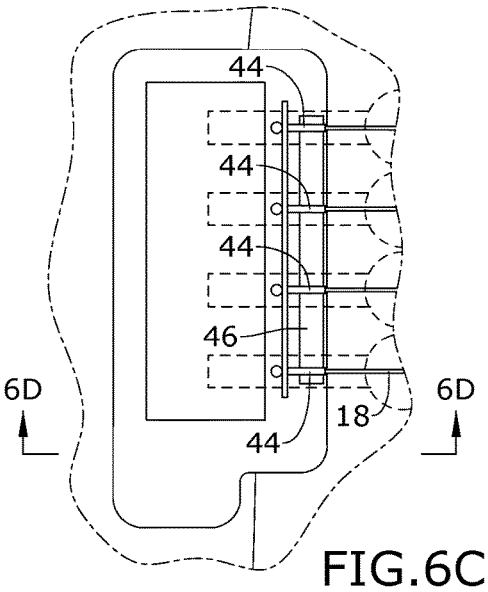
FIG. 6C depicts a schematic view of an alternative embodiment of the musical stringed instrument illustrating a continuous bridge riser.

Bridge 20 of guitar 10 may comprise several variants in alternative embodiments. As depicted in FIGS. 4-5 and 6B, independent bridge risers 42 are coupled to bridge 20 and strings 18 in one embodiment. As depicted in FIG. 6C, continuous bridge riser 46 is coupled to bridge 20 and strings 18 in one embodiment.

Figure 6D:
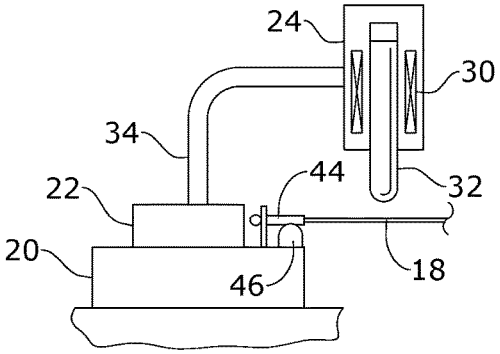
FIG. 6D depicts a side schematic view of the alternative embodiment of the musical stringed instrument shown in FIG. 6C.

It shall be appreciated that each string 18 has to be isolated from the other strings 18 on guitar 10 to prevent the activation and deployment of one or more unintended solenoids 24. This isolation can be achieved by using a generally rigid material such as graphite, foam, stone or other non-conductive material for the components of bridge 20. Alternatively, isolation of the strings can be achieved by disposing insulating sleeves 44 around the ends of strings 18 as depicted in FIG. 6D. Insulating sleeves 44 can be made from any non-conductive material including, but not limited to, rubber, plastic, and the like.

It shall be appreciated that the components of the musical instrument described in several embodiments herein may comprise any alternative known materials in the field and be of any color, size and/or dimensions. It shall be appreciated that the components of the musical instrument described herein may be manufactured and assembled using any known techniques in the field. Although embodiments of the invention relate to a guitar, it shall be appreciated that components of the invention may be used with any alternative musical stringed instrument.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A solenoid triggered actuating system for use with an electrical musical stringed-instrument to permit a user to play the instrument in single-hand and dual-hand operational modes, the electrical musical stringed-instrument comprising a body with a bridge, a neck coupled to the body and comprising a plurality of frets disposed thereon, and a plurality of strings extending over the plurality of frets and comprising first ends coupled to the neck and second ends coupled to the bridge of the body, the system comprising:

a plurality of solenoids coupled to the bridge of the body, each solenoid in the plurality of solenoids corresponding to one of the plurality of strings of the instrument, each solenoid comprising a plunger configured to deploy and retract;

an open switch array coupled to the neck of the instrument and comprising a plurality of momentary switches electrically coupled to the plurality of solenoids, each momentary switch in the plurality of momentary switches corresponding to one of the plurality of solenoids associated with one of the plurality of strings of the instrument; and a plurality of secondary momentary switches coupled to the body of the instrument and electrically coupled to the plurality of solenoids, each secondary momentary switch in the plurality of secondary momentary switches corresponding to one of the plurality of solenoids associated with one of the plurality of strings of the instrument;

wherein each string in the plurality of strings of the instrument is configured to be depressed to contact a corresponding one of the plurality of frets in the instrument to electrically couple the depressed string to the corresponding one of the plurality of solenoids, thereby deploying the plunger of the one of the plurality of solenoids to hammer the corresponding one of the plurality of strings to generate a first sound pertaining to a fretted note;

wherein each momentary switch in the plurality of momentary switches is configured to be depressed to deploy the plunger of one of the plurality of solenoids to hammer the associated one of the plurality of strings to generate a second sound pertaining to an open string note.

2. The solenoid triggered actuating system of claim 1, wherein each secondary momentary switch in the plurality of secondary momentary switches is configured to be depressed to deploy the plunger of the one of the plurality of solenoids to hammer the associated one of the plurality of strings to generate the second sound or a third sound pertaining to another open string note.

3. The solenoid triggered actuating system of claim 2, further comprising a switch electrically coupled to the plurality of frets of the instrument and the open switch array, the switch configured to adjust to an ON position or an OFF position.

4. The solenoid triggered actuating system of claim 3, wherein depression of one of the plurality of strings against the neck of the instrument with the switch in the OFF position and depression of one of the plurality of secondary momentary switches corresponding to the string depressed against the neck activate one of the plurality of solenoids, thereby deploying the plunger of the activated solenoid to hammer the string depressed against the neck to generate the first sound or a fourth sound pertaining to another fretted note.

5. The solenoid triggered actuating system of claim 4, wherein each solenoid in the plurality of solenoids is directly coupled to an arm that is coupled to the bridge of the instrument.

6. The solenoid triggered actuating system of claim 5, wherein the plurality of arms coupled to the plurality of solenoids is directly coupled to a base that is directly coupled to the bridge of the instrument.

7. A solenoid triggered electrical musical stringed-instrument configured to permit a user to play the instrument in single-hand and dual-hand operational modes, the instrument comprising:

a body comprising a bridge disposed thereon;

a neck coupled to the body and comprising a plurality of frets disposed thereon;

a plurality of strings extending over the plurality of frets and comprising first ends coupled to the neck and second ends coupled to the bridge of the body;

a plurality of solenoids coupled to the bridge of the body, each solenoid in the plurality of solenoids corresponding to one of the plurality of strings of the instrument, each solenoid comprising a plunger configured to deploy and retract;

an open switch array coupled to the neck of the instrument and comprising a plurality of momentary switches electrically coupled to the plurality of solenoids, each momentary switch in the plurality of momentary switches corresponding to one of the plurality of solenoids associated with one of the plurality of strings of the instrument; and a plurality of secondary momentary switches coupled to the body of the instrument and electrically coupled to the plurality of solenoids, each secondary momentary switch in the plurality of secondary momentary switches corresponding to one of the plurality of solenoids associated with one of the plurality of strings of the instrument;

wherein each string in the plurality of strings of the instrument is configured to be depressed to contact a corresponding one of the plurality of frets in the instrument to electrically couple the depressed string to the corresponding one of the plurality of solenoids, thereby deploying the plunger of the one of the plurality of solenoids to hammer the corresponding one of the plurality of strings to generate a first sound pertaining to a fretted note;

wherein each momentary switch in the plurality of momentary switches is configured to be depressed to deploy the plunger of one of the plurality of solenoids to hammer the associated one of the plurality of strings to generate a second sound pertaining to an open string note;

wherein each secondary momentary switch in the plurality of secondary momentary switches is configured to be depressed to deploy the plunger of the one of the plurality of solenoids to hammer the associated one of the plurality of strings to generate the second sound or a third sound pertaining to another open string note.

8. The solenoid triggered electrical musical stringed-instrument of claim 7, further comprising a switch electrically coupled to the plurality of frets of the instrument and the open switch array, the switch configured to adjust to an ON position or an OFF position, wherein depression of one of the plurality of strings against the neck of the instrument with the switch in the OFF position and depression of one of the plurality of secondary momentary switches corresponding to the string depressed against the neck activate one of the plurality of solenoids, thereby deploying the plunger of the activated solenoid to hammer the string depressed against the neck to generate the first sound or a fourth sound pertaining to another fretted note.

* * * * *